United States Patent [19]

Minegishi et al.

[11] 4,334,859

[45] Jun. 15, 1982

[54] METHOD AND APPARATUS FOR MELTING MATRIX MATERIALS

[76] Inventors: Susumu Minegishi; Mikio Minegishi, both of Higashiterao-cho 4-17-25, Tsurumi-ku, Yokohama-shi, Japan

[21] Appl. No.: 926,397

[22] Filed: Jul. 20, 1978

[51] Int. Cl.[3] ..... F27B 14/00

[52] U.S. Cl. ..... 432/13; 432/97; 432/99; 432/106

[58] Field of Search ..... 432/13, 96, 99, 106

[56] References Cited

U.S. PATENT DOCUMENTS

| | | | |
|---|---|---|---|
| 2,509,921 | 5/1950 | Gwynn | 432/97 |
| 2,639,215 | 5/1953 | Bland | 432/99 |
| 3,037,940 | 6/1962 | Pixley et al. | 432/106 |
| 3,503,790 | 3/1970 | Grirgras | 432/13 |
| 3,732,993 | 5/1973 | Csapo | 432/13 |
| 3,751,267 | 8/1973 | Sachnik | 432/13 |
| 3,920,380 | 11/1975 | Heian | 432/106 |
| 4,038,025 | 7/1977 | Kratochvil | 432/106 |

*Primary Examiner*—Henry C. Yuen

*Attorney, Agent, or Firm*—Fidelman, Wolffe & Waldron

[57] ABSTRACT

A method and apparatus for economically melting matrix materials, said apparatus comprising a drier, a vertical furnace including a unique arrangement of refractory bars and a rotary kiln and the method including passing the solid matrix material first through a dryer which is heated by the waste gas of a vertical furnace, then to the top of the vertical furnace where it is melted by direct flame contact and thereafter cascading the melted material downwardly through said arrangement of refractory bars as the exhaust from a rotary kiln is blown upwardly through the vertical furnace with the melted material finally flowing from the bottom of the furnace into a rotary kiln where it is further heated and mixed prior to discharge.

2 Claims, 5 Drawing Figures

METHOD AND APPARATUS FOR MELTING MATRIX MATERIALS

BACKGROUND OF THE INVENTION

The present invention relates to a method and apparatus for melting matrix material with higher thermal energy recovery than can be achieved by processes of the prior art.

The term "matrix material", as used in this disclosure, comprehends all materials having viscous softening and homogeneous liquified melting characteristics and also having a homogeneous composition in the solid state. Some examples are glasses, irons, ceramics (such as synopal), artificial lightweight aggregates, and high polymers.

Recovery of thermal energy has become increasingly important in recent years, particularly in the manufacturing industry. Studies of the recovery of thermal energy in processes for melting matrix materials have shown such recovery to be only about 15 and 17 percent of the available thermal energy.

OBJECTS OF THE INVENTION

It is an object of the present invention to provide a novel method and apparatus for melting matrix material which achieve higher thermal energy recovery than achieved by techniques of the prior art.

It is another object of this invention to provide a novel arrangement of refractory bars over which melted matrix material cascades as it is heated by the exhaust gas of a rotary kiln.

It is still a further object of the instant invention to provide the above refractory arrangement wherein hot waste gas can be blown countercurrently through melted matrix material as it cascades downwardly.

Other objects, advantages and novel features of the present invention will become apparent from the following detailed description of the invention when considered in conjunction with the accompanying drawings in which.

DETAILED EMBODIMENT

Figure 1:
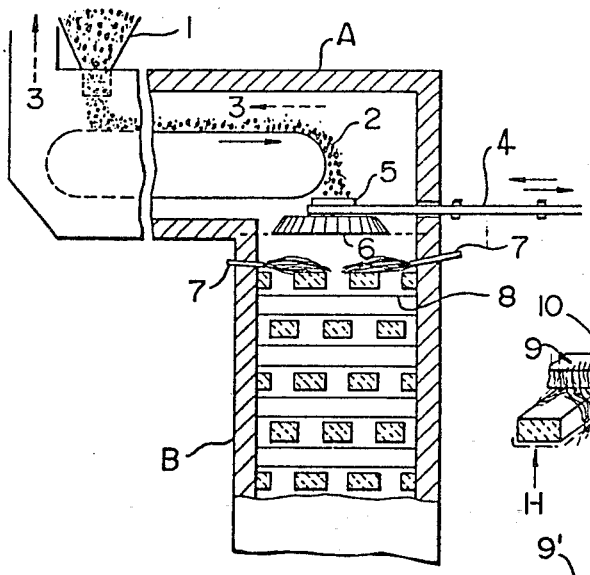
FIG. 1 is a cross-sectional elevation view of the apparatus of this invention.

FIG. 1 shows a material dryer A connected to a vertical furnace B, which discharges melted material into a rotary kiln C. The solid matrix material is delivered from a material hopper 1 onto a pan-shaped conveyor 2 of the dryer A. The material is dried by the hot waste gas 3 blown upwardly from the vertical furnace B. The conveyor 2 is preferably composed of heat-resistant iron.

The vertical furnace B consists of a tower containing a series of horizontal rows of heat and corrosion-resistant refractory bars 8. Examples of commercially-available bar material are Monofrax, a line of fused-cast refractories available from Harbison-Carborundum Corp.

(Pittsburgh, Pa.) and Zirmul, a bonded alumina-zirconia-silica refractory containing a minimum of the glassy phase, available from the Chas, Taylor Sons Co. (Cincinnati, Ohio).

Figure 3:
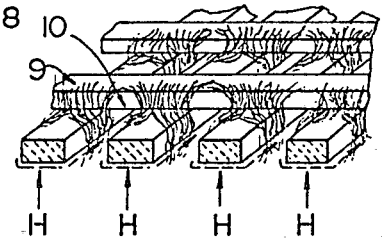
FIG. 3 is a perspective view of melted matrix material flowing between two rows of refractory bars in the novel arrangement of this invention.

FIG. 3 illustrates the novel arrangement of refractory bars of the vertical furnace. Each horizontal row contains a plurality of parallel bars spaced about one bar width apart. The bars of each horizontal row are perpendicular to those in the adjacent rows. The bars of every other row are not vertically aligned, but rather are offset from each other as indicated in FIG. 1.

Referring to FIG. 1, at the upper part of the furnace B, is a material distributor 4 which consists of a small hopper 5 and a material spreading chute 6. The hopper 5 moves to the right and left and distributes material uniformly across the top row of refractory bars which are heated by gas burners 7.

Figure 2:
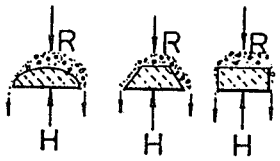
FIG. 2 is a cross-sectional view of matrix material melting over several types of refractory bars.

In operation, the matrix material is heated by burners 7 as it falls from the spreading chute 6 and thereupon begins to flow between the array of refractory bars. FIG. 2 illustrates solid material R falling into contact with the top row of refractory bars. For illustrative purposes only, three differently-shaped refractory bars are shown. The arrow H indicates the direction of the hot waste gas blowing through the furnace B.

Streams 9 of melted matrix material flow as indicated in FIG. 3, thereby forming an open space 10 through which the hot waste gas can be blown (countercurrently) to heat the descending matrix material.

Figure 4:
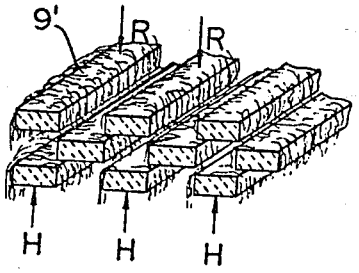
FIG. 4 is a perspective view of melted matrix material flowing through three rows of refractory bars of the prior art.

FIG. 4 presents the arrangement of refractory bars used in the prior art. In this arrangement, wherein all refractory bars are parallel, the streams 9 form a continuous curtain of melted matrix material through which waste gas cannot pass. Thus, in this arrangement, one cannot make use of the heat contained in the hot waste gas from the rotary kiln.

Figure 5:
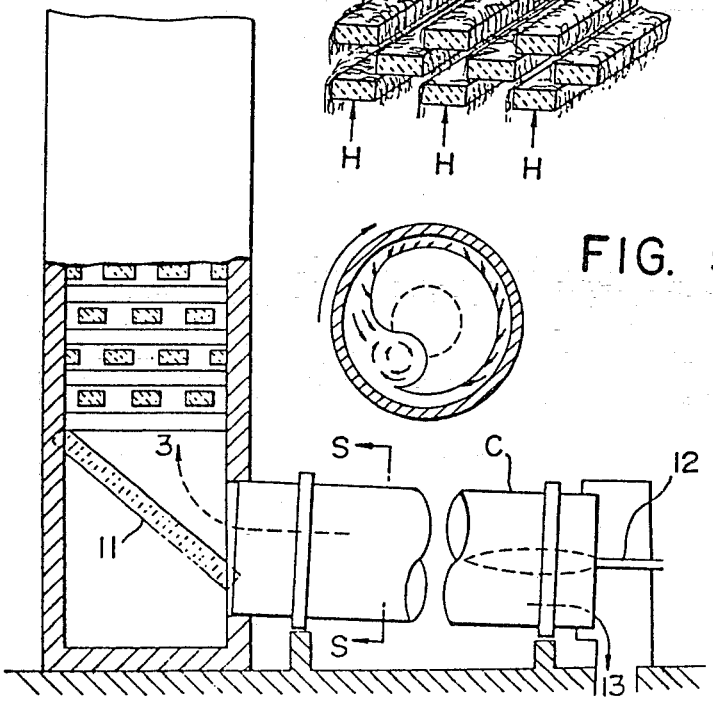
FIG. 5 is a cross-sectional elevation view taken along the line 5—5 of FIG. 1.

The melted matrix material cascades through the array of refractory bars 8 contained in the furnace B and finally falls onto refractory element 11. The melt then flows along element 11 into the rotary kiln C where it is mixed (as shown in FIG. 5) while being heated by a burner 12. Finally, a uniform melt is recovered from the kiln through an exit port 13.

The apparatus of this invention achieves high recoveries of thermal energy due to the combination of three features:

(i) efficient drying of solid matrix material with the waste gas of furnace B;

(ii) effective use of the thermal energy contained in the hot waste gas of the rotary kiln C by providing a novel arrangement of refractory bars over which the melted material may flow while being heated by countercurrent flow of said waste gas; and (iii) effective heating and mixing in the rotary kiln C.

Recoveries of at least 55 percent of the thermal energy available in the exhaust of the rotary kiln have been achieved by the method of this invention.

What is claimed is:

1. A process for melting matrix materials which form highly viscous liquids in an apparatus including a drying conveyor, a vertical shaft furnace and a direct fired rotary kiln which are serially connected and adapted to conduit combustion gases from the rotary kiln upwardly through the vertical furnace and across the drying conveyor countercurrent to the flow of matrix material, the steps comprising feeding solid particulate matrix material onto the drying conveyor, distributing dried and heated material from the conveyor across the top of the vertical furnace to contact upwardly rising hot combustion gases from the rotary kiln, cascading melting matrix material downwardly through the vertical furnace over a series of gas-liquid contact means comprising a plurality of vertically spaced rows of parallel refractory bars, said bars spaced apart horizontally about one bar width with adjacent rows being angularly displaced by about 90° and alternate rows being offset horizontally about one bar width whereby open gas channels are maintained from the top to the bottom of the vertical furnace, and passing viscous, molten matrix material from the furnace bottom into the rotary kiln for further heating and mixing.

2. Apparatus for melting matrix materials which form highly viscous liquids comprising a drying conveyor, a vertical shaft furnace and a direct fired rotary kiln all serially connected and adapted to conduct combustion gases from the rotary kiln upwardly through the vertical furnace and across the drying conveyor countercurrent to the flow of matrix materials, said furnace containing gas-liquid contact means, said means comprising a plurality of vertically spaced rows of parallel refractory bars, said bars spaced apart horizontally about one bar width, adjacent rows of bars being angularly displaced by approximately 90° and alternate rows being offset horizontally approximately one bar width to thereby create and maintain a large surface area for gas-liquid contact while allowing free passage of gas upwardly through the furnace.

* * * * *